United States Patent [19]

Luke

[11] 4,292,032

[45] Sep. 29, 1981

[54] PRODUCTION OF TOBACCO-SMOKE FILTERS

[75] Inventor: John A. Luke, Romsey, England

[73] Assignee: British-American Tobacco Company Limited, London, England

[21] Appl. No.: 81,864

[22] Filed: Oct. 4, 1979

[30] Foreign Application Priority Data

Oct. 19, 1978 [GB] United Kingdom ..... 41133/78

[51] Int. Cl.[3] ..... A24C 5/50

[52] U.S. Cl. ..... 493/43; 425/105; 425/115; 425/374; 425/392; 493/49

[58] Field of Search ..... 93/1 C, 77 FT; 131/261 B, 269, 10.3, 10.5, 90, 93, 88, 216; 425/374, 392, 105, 104, 115; 264/129; 493/43, 49, 47, 42, 39

[56] References Cited

U.S. PATENT DOCUMENTS

| | | | |
|---|---|---|---|
| 2,954,773 | 10/1960 | Lebert | 131/10.5 |
| 3,164,157 | 1/1965 | Lebert | 131/10.3 |
| 4,149,546 | 4/1979 | Luke et al. | 131/94 |
| 4,213,470 | 7/1980 | Horsewell et al. | 131/261 B |
| 4,219,033 | 8/1980 | Horsewell et al. | 131/261 B |

*Primary Examiner*—James F. Coan

*Attorney, Agent, or Firm*—Kane, Dalsimer, Kane, Sullivan & Kurucz

[57] ABSTRACT

For producing rod-shaped tobacco-smoke filter components each having one or more annular tobacco-smoke barriers, annular grooves open at their peripheries are formed in rod-shaped bodies of smoke-filtration material, the grooved bodies are conveyed in a direction transverse to their longitudinal axes along an arcuate path, and settable barrier material is deposited in the grooves during the conveyance along said path, the bodies being rotated about their said axes during the deposition of the barrier material.

Apparatus for producing said rod-shaped tobacco-smoke filter components comprises means for forming annular grooves open at their peripheries in rod-shaped bodies of smoke-filtration material, means for conveying the grooved bodies in a direction transverse to their longitudinal axes along an arcuate path, means for depositing settable smoke-barrier material in the grooves during the conveyance in the said path, and means for rotating the bodies about their said axes during the deposition of the barrier material. The means for depositing the barrier material may comprise a rotary disc member or members which extends or extend into the groove or grooves of each grooved body and a bath of the said material on which the rotary disc member or members is or are mounted so as to dip into the said material.

20 Claims, 2 Drawing Figures

PRODUCTION OF TOBACCO-SMOKE FILTERS

Figure 1:
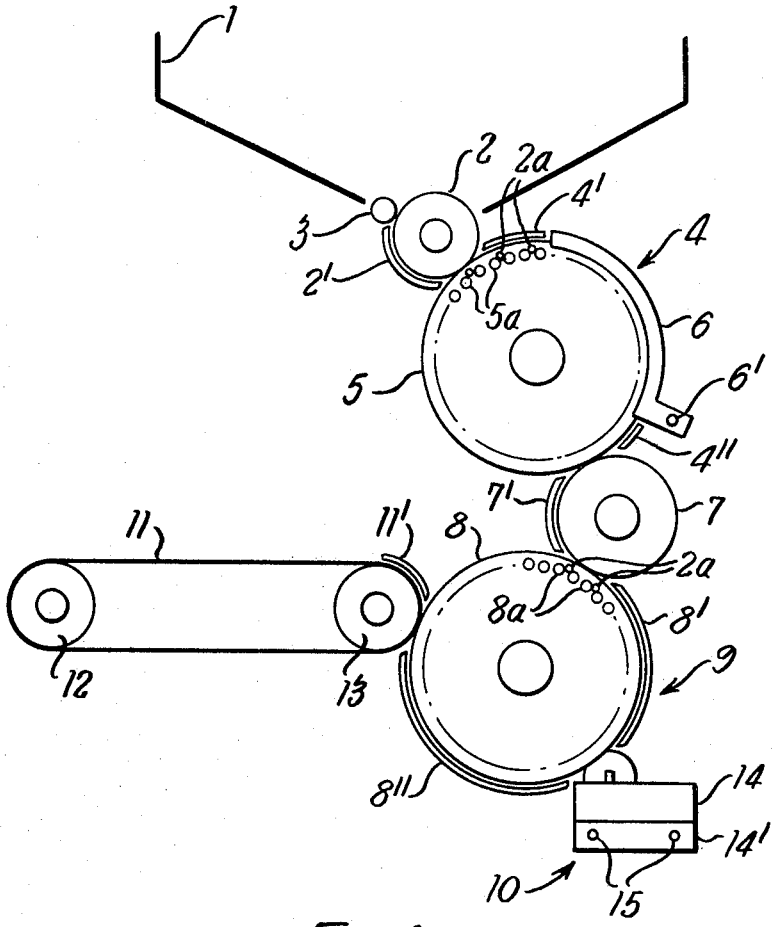

This invention concerns improvements relating to the production of tobacco-smoke filter components.

United Kingdom Patent Specification No. 1,436,636 describes a cigarette filter intended for the removal of total particulate matter and comprising, intermediate first and second plugs of tobacco-smoke filtration material, such as cellulose acetate, a disc member having a small bore aperture therethrough providing a smoke-accelerating orifice. The assembly of such filters requires a sequential arrangement of three separate components relative one to the other, necessitating complex and costly filter assembly machinery.

The present invention provides a method for producing rod-shaped tobacco-smoke filter components with one or more annular tobacco-smoke barriers, wherein rod-shaped bodies of smoke-filtration material formed with annular grooves open at their peripheries are conveyed in a direction transverse to their longitudinal axes along an arcuate path, and settable barrier material is deposited in the grooves during the conveyance along said path, the bodies being rotated about their said axes during the deposition of the barrier material, whereby filter components with annular smoke barriers are produced.

The invention also comprises a method for producing rod-shaped tobacco-smoke filter components each having one or more annular tobacco-smoke barriers, wherein annular grooves open at their peripheries are formed in rod-shaped bodies of smoke-filtration material, the grooved bodies are conveyed in a direction transverse to their longitudinal axes along an arcuate path, and settable barrier material is deposited in the grooves during the conveyance along said path, the bodies being rotated about their said axes during the deposition of the barrier material, whereby filter components with annular smoke barriers are produced. In some cases, the forming of the grooves and the deposition of the barrier material may be carried out in successive parts of a single arcuate path of conveyance.

Preferably the rod-shaped bodies are conveyed continuously along the arcuate path during the deposition of the barrier material and are continuously rotated about their axes throughout their travel along the arcuate path.

The present invention further provides apparatus for producing rod-shaped tobacco-smoke filter components each having one or more annular tobacco-smoke barriers, comprising means for forming annular grooves open at their peripheries in rod-shaped bodies of smoke-filtration material, means for conveying the grooved bodies in a direction transverse to their longitudinal axes along an arcuate path, means for depositing settable smoke-barrier material in the grooves during the conveyance in the said path, and means for rotating the bodies about their said axes during the deposition of the barrier material, whereby filter components with annular smoke barriers are produced.

The conveying means is preferably of drum-like form, the rotation means in this case suitably comprising a series of rollers carried by the conveying means, the rollers, as viewed endwise being disposed in a circular array. The supply means may comprise a rotary member or members arranged to extend into the or each groove of each filter component.

Figure 2:
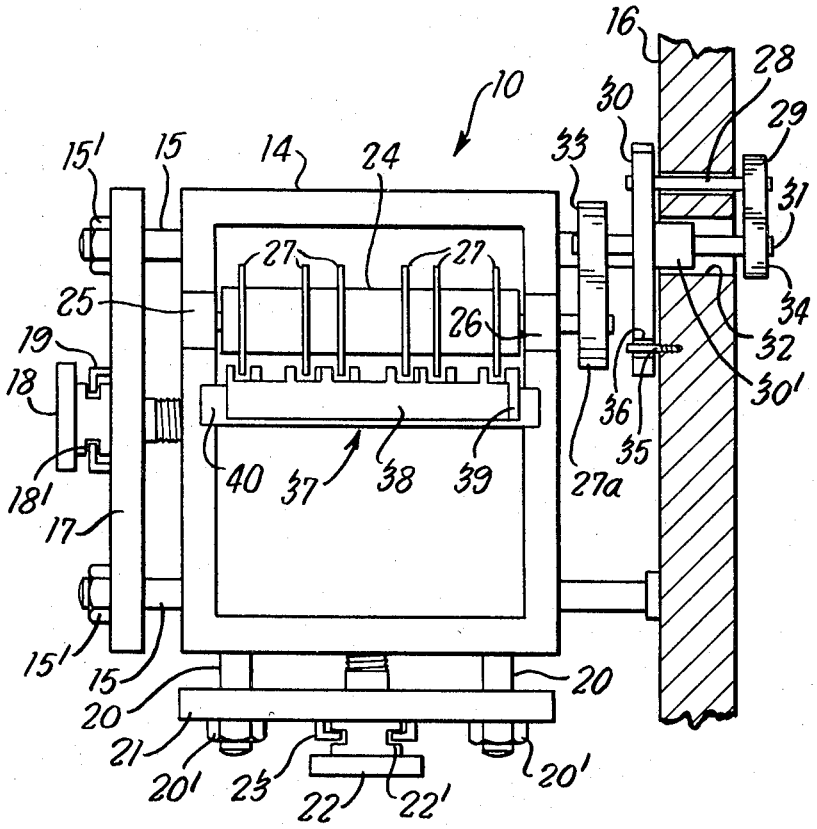

In order that the present invention may be clearly understood and readily carried into effect, reference will now be made, by way of example, to the accompanying diagrammatic drawings in which:

FIG. 1 shows a front elevation of apparatus for operating on rod-shaped tobacco-smoke cigarette filter components; and FIG. 2 shows a plan view, to a larger scale, of barrier material deposition means of the apparatus of FIG. 1.

Referring to FIG. 1, the apparatus there shown comprises a hopper 1, in a lower opening of which is located a feed drum 2 and, adjacent to the feed drum 2, a smaller diameter rejection roller 3. The feed drum 2, which at its periphery is provided with flutes in known manner, is operable to feed rod-shaped filter-plug bodies **2*a* from the hopper 1 to a rod-forming assembly 4 comprising a rotary drum 5 and an arcuate former 6. A fluted transfer drum 7 is operable to receive rods from the drum 5 and to transfer them to a rotary conveying drum 8 of barrier material deposition means 9 comprising a barrier-material supply unit 10. The apparatus further includes an endless conveyor band 11 which is trained about pulleys 12 and 13 and is arranged to receive filter rods from the drum 8**. The apparatus may further include means for applying a wrapping, if so desired.

The rod-forming assembly 4 is similar in construction and operation to that described in the specification of U.S. Pat. No. 4,149,546. Mounted around the periphery of the drum 5 are small diameter driven support rollers **5*a* the axes of which are parallel to the axis of the roller 5. Pairs of adjacent support rollers serve to rotate and support rods 2*a* fed from the feed drum 2 while the rods are carried through the assembly 4 by the turning of the drum 5. The former 6 comprises radially inwardly projecting ribs (not shown), and heating means, preferably in the form of electrical elements. When desired, the former 6 can be pivoted, about a pivot 6'**, out of its operative position shown.

The conveying drum 8 of the deposition means 9 is generally similar in construction to the drum 5 of the rod-forming assembly 4 and is provided with a similar series of peripheral driven support rollers **8*a* for the continuous rotation and support of the rods 2*a* at the periphery of the drum 8**.

Arcuate retaining members 2', 4' and 4'', 7', 8' and 8'', and 11', are associated with the drums 2, 5, 7 and 8 and the pulley 13. These retaining members serve to hold and guide the rods in contact with the associated rotative members.

The barrier material supply unit 10 comprises a bath 14 for holding fluid barrier material, the bath being slidably mounted on a block 14' which in turn is slidably mounted on two rods 15 fixedly secured in and extending perpendicularly to wall member 16 (see FIG. 2) of the apparatus. A cross plate 17 is secured by means of nuts 15' at the outer ends of the rods 15. A screw 18 passes through a clearance hole (not shown) in the plate 17 and is threadedly received in a bore (not shown) in the block 14'. The head of the screw 18 comprises an annular groove 18' in which are received radially inwardly extending fingers of a bracket member 19. Thus the screw 18 is captive relative to the plate 17 and, by turning the screw 18 the bath 14 can be slidably moved on the rods 15 towards or away from the wall member 16.

Adjustment of the position of bath 14 in a direction parallel to the wall member 16 is obtainable by similar means to those just described. Rods 20 are secured in the block 14' and a cross plate 21 is secured, by means of nuts 20', at the outer ends of the rods 20. A screw 22 passes through a clearance hole (not shown) in the plate 21 and is threadedly received in a bore in the base of the bath 14. The screw 22 is held captive relative to the plate 21 by inwardly projecting fingers of bracket member 23, the fingers being received in an annular groove 22' of the screw 22. Thus turning of the screw 22 causes the bath 14 to slide relative to the block 14'.

The unit 10 further comprises a roller 24 mounted on the bath 14 in bearings 25 and 26 so as to extend parallel to the axis of the drum 8. The roller 24 carries six discs 27 of equal diameter, which discs are of a thickness of, for example, 1.25 mm. The roller 24 is provided with a toothed wheel **27*a* mounted on a portion of the spindle of the roller 24 extending rightwardly of the bearing 26, as viewed in FIG. 2. Provision, now to be described, is made for driving the toothed wheel 27*a*, whilst permitting the position of the bath 14 to be adjusted parallel to and perpendicularly of the wall member 16**, as above described.

A shaft 28 is journalled for rotative movement in the wall member 16 and carries at the end thereof further from the bath 14, a toothed wheel 29, and at its other end an arm 30 extending parallel with the wall member 16. The wheel 29 is keyed to the shaft 28 and the arm 30 is mounted for rotation thereon. A bearing housing 30' is formed integrally with the arm 30 and a second shaft 31 is journalled for rotative movement in the housing 30', the shaft 31 and housing 30' extending within an arcuate clearance hole 32 in the wall member 16. There is keyed to the shaft 31 at one end thereof a toothed wheel 33 which meshes with the toothed wheel **27*a* of the roller 24. At its other end the shaft 31 carries a toothed wheel 34 which is keyed to the shaft 31 and meshes with the toothed wheel 29. The arm 30 is resiliently urged, (by means not shown), about the shaft 28 so as to maintain the wheel 33 in mesh with the wheel 27*a*. A stop pin 35 threadedly received in the wall member 16 extends through an arcuate clearance hole 36 in the arm 30 so as to limit the rotative movement of the arm 30 about the shaft 28 should the bath 14** be removed.

Associated with the roller 24 is a doctor blade 37 of compound construction. The compound doctor blade 37 comprises a first blade member 38 which, as can be seen from FIG. 2, has six teeth projecting therefrom, each tooth being located to the left of a respective one of the discs 27. A second blade member 39 is disposed beneath the first blade member 38 and has six teeth located to the right of respective discs 27. The blade members 38 and 39 are supported by a plate 40 which rests upon upper wall surfaces of the bath 14. Adjustment means (not shown) are operable to adjust independently the positions of the blade members 38 and 39 so as to increase or descrease the spaces between the teeth and the side faces of the discs 27, and to move independently the ends of the plate 40 towards or away from the roller 24.

The drums 2,3,5,7,8, the pulley 12, and the toothed wheel 29 associated with the roller 24 are driven by a single electric motor (not shown) through gear trains (also not shown), the toothed wheels of which are mounted on the wall member 16. There are provided two further electric motors (not shown), of speed-controllable type, which with associated gear trains are operable to drive the peripheral rollers **5*a* and 8*a* of the drums 5 and 8 respectively. The drums 5 and 8 and the respective series of peripheral rollers thereof are rotated in a clock-wise sense, the drums 2,3 and 7, the pulley 12 and the roller 24** being rotated in an anti-clockwise sense.

In operation of the apparatus shown in FIG. 1, rods, suitably six times the length of individual filter plugs, are fed into the hopper 1, and the bath 14 is charged with barrier material. With rods of cellulose acetate for example, the barrier material may be a hot melt material such as polyethylene, in which case the bath is provided with suitable heating means, preferably in the form of electrical elements.

The feed drum 2 transfers rods one-by-one from the hopper 1 to the drum 5 of the rod-forming assembly 4. The rejection roller 3 with its anti-clockwise rotation, serves to ensure an even flow of the rods from the hopper 1 to the drum 2. As the rods are carried by the drum 5, and rotated about their axes by the peripheral support rollers **5*a*, in contact with the heated ribs of the former 6, annular grooves, six in number, are formed in each of the rods. The thus formed rods are then transferred by the drum 7 onto the drum 8 of the deposition means 9 where each rod is again rotated about its axis under the action of the peripheral support rollers 8*a*. The rods are carried by the drum 8 to the barrier material supply unit 10, the arrangement being such that the discs 27 of the roller 24 extend partially each into one of the annular grooves formed in the rods. As the discs 27 revolve, lower portions thereof are immersed in the fluid barrier material in the bath 14, and thus barrier material is deposited in each of the grooves so as to produce in each groove an annular tobacco-smoke barrier. The amount of barrier material carried at the peripheries of the discs 27 to the grooves of the filter components is influenced, of course, by the setting of the compound doctor blade 37**, as is also the form of the resultant barriers.

Rods passing from the unit 10 are transferred to the conveyor band 11.

The above described method and apparatus provide practical means for producing filter plugs for use in filters as described in the specification of U.S. patent application Ser. No. 839,297, now U.S. Pat. No. 4,219,033.

We claim:

1. A method for producing rod-shaped tobacco-smoke filter components each having at least one annular tobacco-smoke barrier, wherein rod-shaped bodies of smoke-filtration material formed with at least one annular groove open at the periphery are rotated about their longitudinal axes while being conveyed in a direction transverse to their said axes along an arcuate path past at least one deposition member for a settable liquid barrier material supplied to that member, the said member being located to extend into the grooves during the conveyance of the bodies along the path, the material being transferred from surface to surface of the member and grooves during the relative movement between them and the barriers being produced by the material when set.

2. A method for producing rod-shaped tobacco-smoke filter components each having at least one annular tobacco-smoke barrier, wherein annular grooves open at their periphery are formed in rod-shaped bodies of smoke-filtration material, the rod-shaped bodies being rotated about their longitudinal axes while being conveyed in a direction transverse to their axes along an arcuate path past at least one deposition member for a settable liquid barrier material supplied to that member, the member being located to extend into the grooves during the conveyance of the bodies along the path, the material being transferred from suface to surface of the member and grooves during the relative movement between them and the barriers being produced by the material when set.

3. A method according to claim 2, wherein the grooves in the rod-shaped bodies are formed by the application of heat and pressure.

4. A method according to claim 1 or 2, wherein the rod-shaped bodies are made of a thermoplastics material such as cellulose acetate.

5. A method according to claim 2, wherein the grooves are formed in the rod-shaped bodies while the latter are being conveyed in a direction transverse to their longitudinal axes along an arcuate path.

6. Apparatus for producing rod-shaped tobacco-smoke filter components each having at least one annular tobacco-smoke barrier, comprising means for conveying rod-shaped bodies of smoke-filtration material, each having at least one annular groove open at the periphery, in a direction transverse to their longitudinal axes along an arcuate path, means for rotating the bodies about their axes while being so conveyed, and at least one deposition member for a settable liquid barrier material supplied to that member, the member being located to extend into the grooves during the conveyance of the bodies along the path, whereby said material is transferred from surface to surface of the member and grooves during the relative movement between them, said barriers being produced by the material when set.

7. Apparatus according to claim 6, wherein the conveying means comprises a rotary drum at the periphery of which the grooved bodies are supported and guided along the arcuate path.

8. Apparatus according to claim 6, wherein the deposition member is a rotary disc member.

9. Apparatus according to claim 8 and comprising a bath which contains the barrier material and the rotary disc member is so mounted as to be partially immersed in the material.

10. Apparatus according to claim 9 wherein the bath is adjustable in a direction parallel to the longitudinal axes of the rod-shaped bodies and their conveyance along the arcuate path.

11. Apparatus according to claim 9 or 10, wherein the bath is adjustable in a direction towards and away from the rod-shaped bodies in their conveyance along the arcuate path.

12. Apparatus according to claim 8 or 9, wherein toothed doctor blades associated with said rotary disc member are adjustable for determining the spacing between the teeth of the blades and the side faces of said member.

13. Apparatus according to claim 9, comprising means for adjusting the position of the bath and driving means for rotating the rotary disc member which includes gearing adapted for maintaining the drive thereto in all positions of adjustment of the bath.

14. Apparatus for producing rod-shaped tobacco-smoke filter components each having one or more annular tobacco-smoke barriers, comprising means for forming annular grooves open at their peripheries in rod-shaped bodies of smoke-filtration material, means for conveying the grooved bodies in a direction transverse to their longitudinal axes along an arcuate path, means for depositing settable smoke-barrier material in the grooves during the conveyance in the path, and means for rotating the bodies about their said axes during the deposition of the barrier material, whereby filter components with annular smoke barriers are produced, the means for depositing the barrier material in the annular groove comprising at least one rotary disc member which extends into a said groove of each grooved body in the course of its conveyance along the arcuate path and means for supplying the barrier material to the rotary member.

15. Apparatus according to claim 14, wherein the conveying means comprises a rotary drum at the periphery of which the grooved bodies are supported and guided along the arcuate path.

16. Apparatus according to claim 14, wherein the supply means comprises a bath which contains the barrier material and on which said rotary disc member is mounted so as to be partially immersed in the material.

17. Apparatus according to claim 16, wherein the bath is adjustable in a direction parallel to the longitudinal axes of the rod-shaped bodies in their conveyance along the arcuate path.

18. Apparatus according to claim 16 or 17, wherein the bath is adjustable in a direction towards and away from the rod-shaped bodies in their conveyance along the arcuate path.

19. Apparatus according to claim 14 or 16, wherein toothed doctor blades associated with said rotary disc member are adjustable for determining the spacing between the teeth of the blades and the side faces of said member.

20. Apparatus according to claim 16, comprising means for adjusting the position of the bath and driving means for rotating the rotary disc member which includes gearing adapted for maintaining the drive thereto in all positions of adjustment of the bath.

* * * * *